United States Patent [19]

Vanderleest

[11] 4,050,397

[45] Sept. 27, 1977

[54] FOIL FENCE FOR HYDROFOIL CRAFT

[75] Inventor: Siebold Vanderleest, Bellevue, Wash.

[73] Assignee: The Boeing Company, Seattle, Wash.

[21] Appl. No.: 680,627

[22] Filed: Apr. 26, 1976

[51] Int. Cl.[2] ..... B63B 1/24

[52] U.S. Cl. ..... 114/274; 244/91

[58] Field of Search ..... 114/66.5 H, 274–282; 244/91, 40 R, 40 A

[56] References Cited

U.S. PATENT DOCUMENTS

| | | | |
|---|---|---|---|
| 2,576,981 | 12/1951 | Vogt | 244/91 |
| 2,649,265 | 8/1953 | Grant | 244/91 |
| 2,805,032 | 9/1957 | Davis | 244/91 X |
| 3,208,422 | 9/1965 | Schopmeyer | 114/66.5 H |
| 3,411,738 | 11/1968 | Sargent | 244/91 X |
| 3,438,597 | 4/1969 | Kasper | 244/87 X |
| 3,504,649 | 4/1970 | Scherer | 114/278 |
| 3,845,918 | 11/1974 | White, Jr. | 114/66.5 H X |

*Primary Examiner*—Trygve M. Blix
*Assistant Examiner*—Sherman D. Basinger
*Attorney, Agent, or Firm*—Nicolaas DeVogel; Kenneth W. Thomas; J. Peter Mohn

[57] ABSTRACT

A predetermined-sized and shaped foil-fence structure which is substantially perpendicularly mounted at the foil-tip of a hydrofoil craft and projects downward, upward or partly downward and upward from the foil-tip. The fence surfaces are generally disposed parallel to the longitudinal axis of the craft.

14 Claims, 18 Drawing Figures

Fig. 3
PRIOR ART
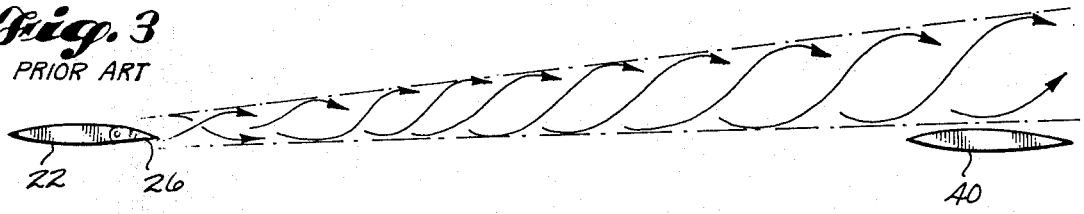
Fig. 4
PRIOR ART
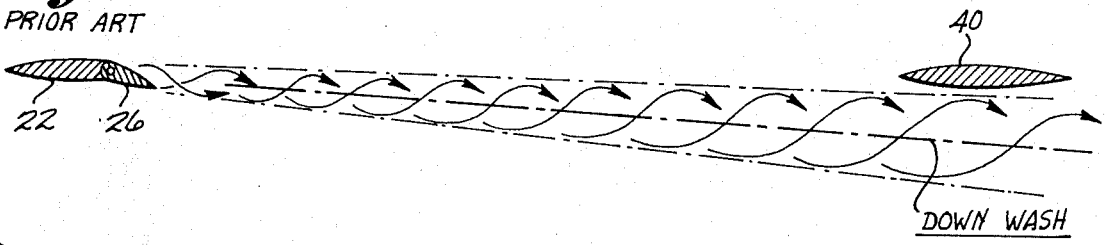
Fig. 5
PRIOR ART
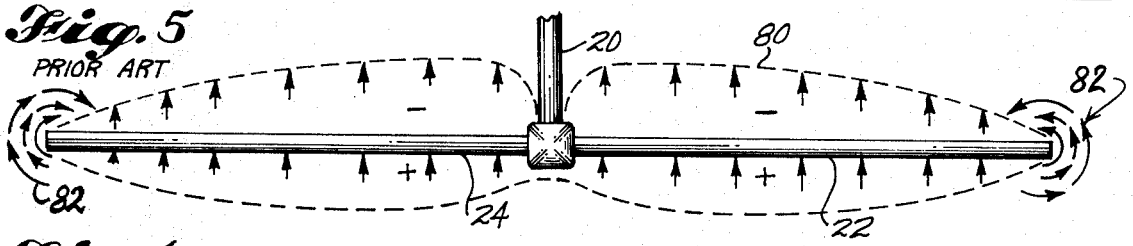
Fig. 6
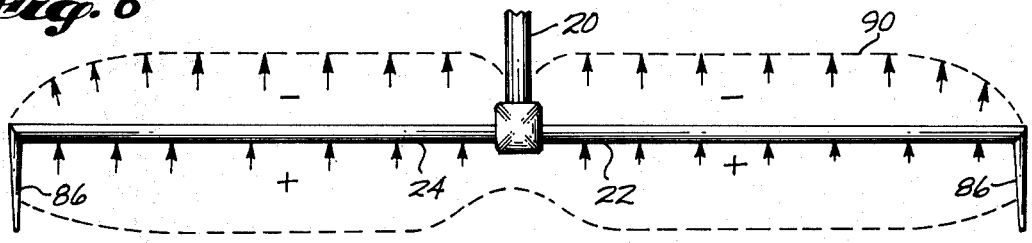
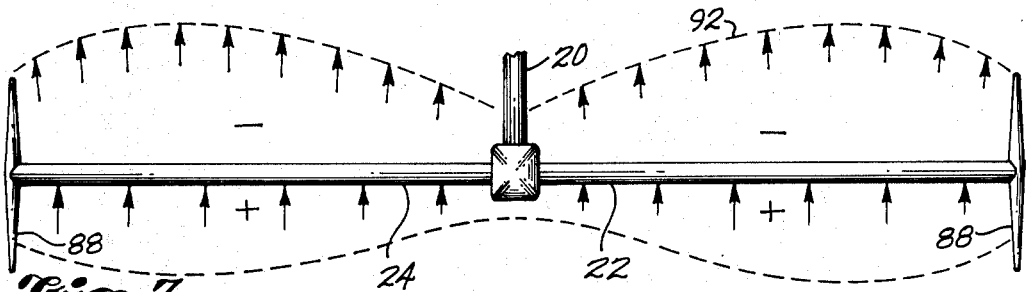
Fig. 7
Fig. 8
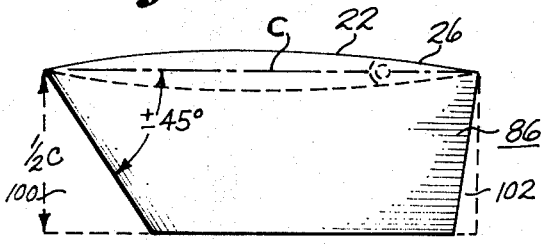
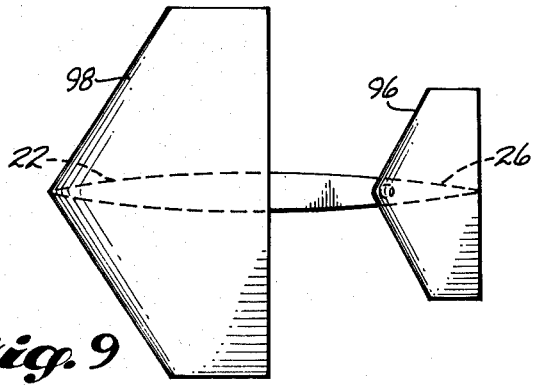
Fig. 9

Fig. 10
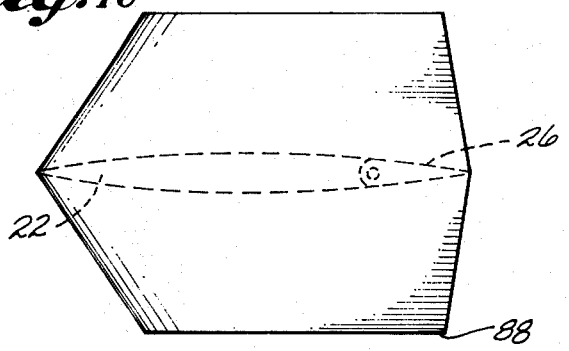
Fig. 11
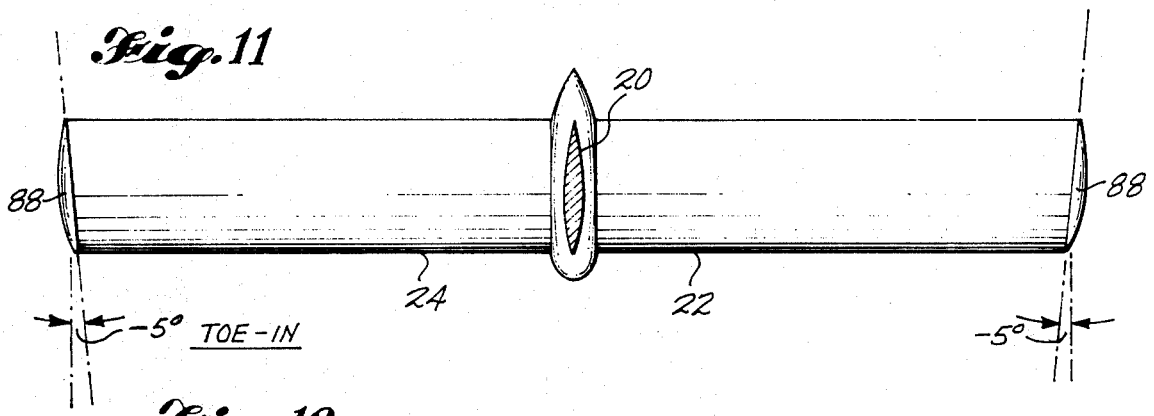
Fig. 12
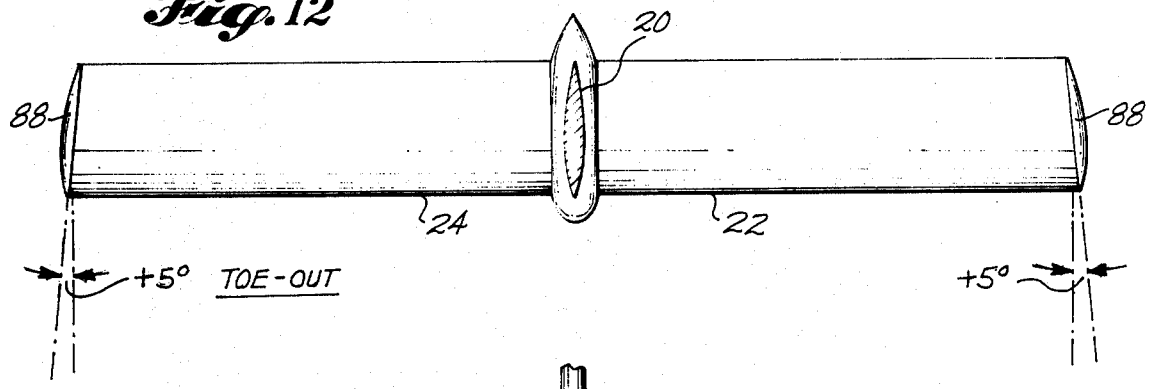
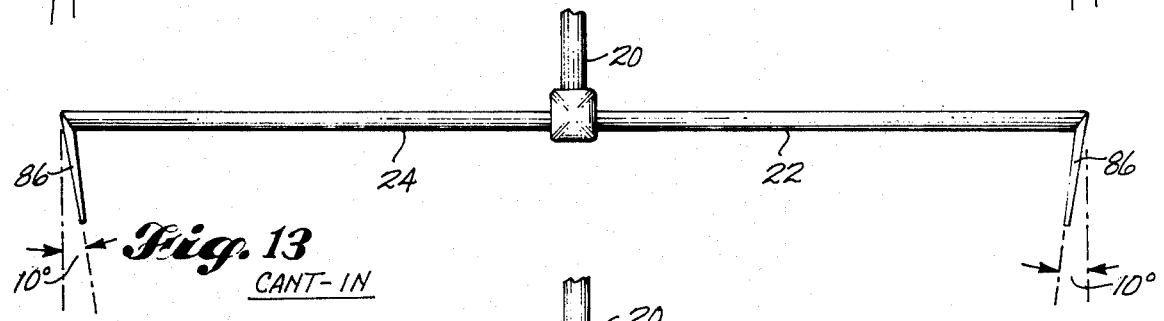
Fig. 13
CANT-IN
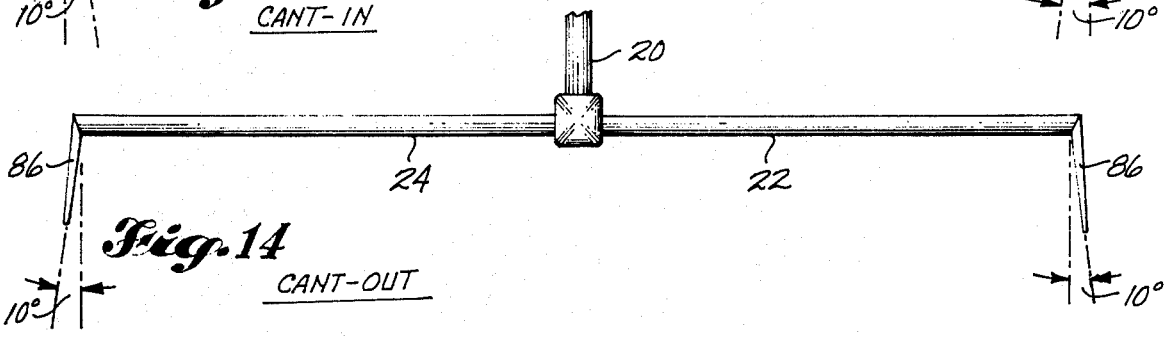
Fig. 14
CANT-OUT

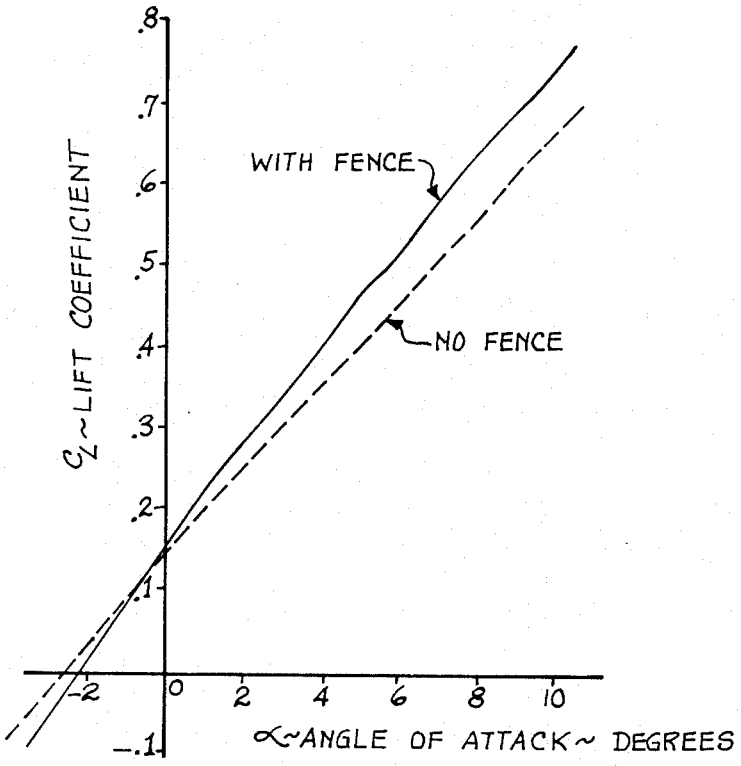
Fig. 18
Fig. 15
PRIOR ART
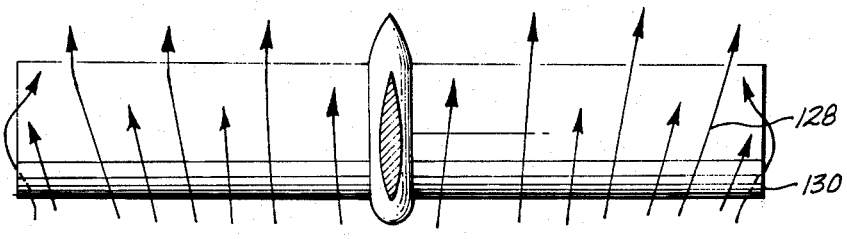
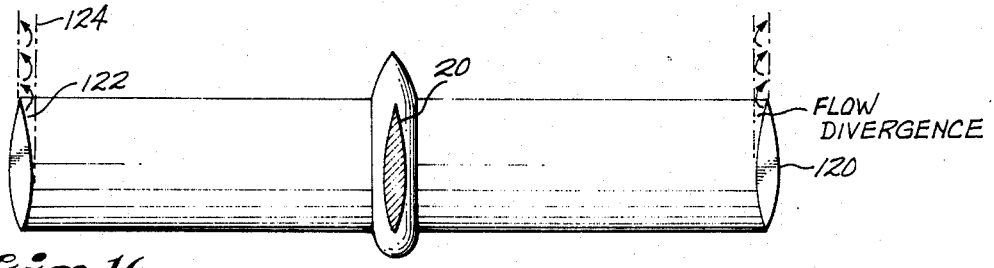
Fig. 16
PRIOR ART
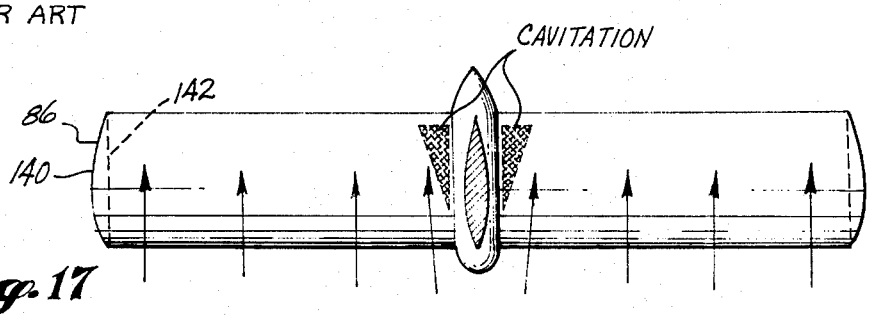
Fig. 17

FOIL FENCE FOR HYDROFOIL CRAFT

BACKGROUND OF THE INVENTION a. Field of the Invention

The present invention relates to foil fences for hydrofoil craft utilizing the submerged foil system and in particular to the hydrofoil craft having the "canard" foil arrangement.

b. Description of the Prior Art

The utilization of perpendicularly oriented fences at a foil tip has been tested and resulted in a reduction of drag especially in the take-off period of the hydrofoil craft.

Foil fences for the purpose of improving speed and preventing vortex development at the foil tip and for improving the lift distribution of the foil have not been observed in the hydrofoil art. The closest approach was noted only in the similarity of structure where the use of perpendicularly oriented stabilizing fins was shown, such as in the U.S. Patents Nos:

3,183,871
3,425,383
3,635,035
3,688,723

However, the stated purpose for the fin structure of these patents is that of stabilization only and not drag reduction and/or improvement of lift distribution.

The closest approach to the present invention of using a fence or fin on a foil or wing-tip for vortex influence control was noted in the aircraft prior art, in U.S. Pat. Nos. 2,576,981 and 3,152,775.

SUMMARY OF THE INVENTION

The present invention comprises a fence structure for the foil-tip of hydrofoil craft utilizing the submerged foil system. The foil plans of all the hydrofoil craft constructed up to the present time present a confusing array of foil arrangements. All of these arrangements, however, are classified by their longitudinal distribution of the foil area, such as:

1. canard,
2. airplane, and
3. tandem arrangement.

The canard arrangement comprises a short length foil at the bow normally supported by one strut and a longer length spanwise foil at the stern, while the airplane arrangement is opposite of the canard and the "tandem" is an equal spanwise foil length at bow and stern. The present invention applies to all three arrangements but appears most beneficial to the canard system.

Accordingly, the following explanation, the figures enclosed herewith, and the advantages obtained are herein explained for the canard arrangement and in most instances apply to the other submerged foil arrangements but to a lesser degree.

Considering the forward foil supported by a strut in the center of the foil it appears that during forward motion of the craft at all lifting conditions a vortex develops immediately at each foil tip. This vortex causes a cone of disturbed whirling water which as a down-wash will affect the lifting capability of the aft foils. Preventing the vortex occurrence at the forward tip by the use of a fence will therefore improve the aft lifting capability.

Furthermore, a fence at the tips of the forward foil will enforce the lift distribution spanwise of the foil as will be explained hereinafter.

In addition, it will be shown, as has been by the media of wind-tunnel tests and full scale hydrofoil flight test, that drag is reduced and lift improved which is particularly important at take-off speed, when the craft gathers momentum and raises itself on its foils to become foil-borne for maximum speed.

In the aerodynamic art, the use of fences was considered and showed promise for supersonic airplanes such as the SST-type airplane. In the aerodynamic fence configuration, the fences or fins had a symmetric profiled cross-section. A rounded leading edge tapered in curved fashion to a sharp-pointed trailing edge. Such a typical aerodynamic cross-section when installed at a wing tip would provide at the trailing part and wing surface intersection a triangular wing surface increase which does not cause any significant disturbance in the aerodynamic art. In the hydrodynamic hydrofoil art it reacts differently and it was discovered that a flow separation occurred which caused cavitation, drag and irregular vortex actions. By designing the fence profile with a substantially flat inboard area, the flow separation was prevented and cavitation did not occur, besides the fact that the mounting procedure was significantly simplified. Thus the flat inboard fence surface avoided flow separation and maintained the fence lift advantages.

An important improvement of the installed fences on the foil tips was noted during the up or down deflection of foil flaps. During a no-fence ride of the craft, a significant vortex action appears all along the trailing edge at flap deflection while at a fence-installed ride the vortex action at normal angle flap deflections was practically non-existent.

It is therefore an object of the present invention to increase the lift of a hydrofoil craft.

It is another object of the present invention to reduce the drag of a hydrofoil craft.

It is an important object of the present invention to provide for a foil system for hydrofoil craft that prevents the occurrence of vortex activity and improves over-all ride and effectiveness of the craft.

The novel features which are believed to be characteristic of the invention, both as to its organization and method of operation, together with further objects and advantages thereof, will be better understood from the following description considered in connection with the accompanying drawing in which several embodiments of the invention is illustrated by way of example. It is to be expressly understood, however, that the drawing is for the purpose of illustration and description only and is not intended as a definition of the limits of the invention.

FIG. 3 is a side view of FIG. 1.

FIG. 4 is a longitudinal sectional side view of FIG. 2 with a downward foward foil flap deflection.

FIG. 5 is a front view of a submerged forward foil.

FIG. 6 is a similar front view of a submerged forward foil with a fence mounted at the foil tips.

FIG. 7 is a similar front view of a submerged forward foil with another fence configuration mounted at the foil tips.

FIGS. 8, 9 and 10 are illustrations of various foil tip fence configurations.

FIG. 11 illustrates a plan view of the forward foil span with toe-in mounted fences.

FIG. 12 illustrates a plan view of the forward foil span with toe-out mounted fences.

FIG. 13 illustrates a front view of a strut-supported foil with cant-in mounted fences.

FIG. 14 illustrates a front view of a strut supported foil with cant-out mounted fences.

FIG. 15 is a plan view of the submerged foil shown in FIG. 5.

FIG. 16 is a similar plan view as illustrated in FIG. 15 with typical aerodynamically profiled fin tips as tested and used in the aerodynamic field.

FIG. 17 is a similar plan view as illustrated in FIG. 15 with foil tip mounted fences as per present invention with the most preferred fence embodiment.

FIG. 18 is an actual chart indicating the lift advantage obtained by the utilization of the present invention.

OPERATION OF THE INVENTION

The drawings illustrate by way of example and not by way of limitation the preferred forms of the invention. As discussed above, the submerged foil tips utilized in the conventional hydrofoil art produce foil tip vortexes. The cause of the vortex is a combination of the foil tip flow actions as illustrated in FIG. 5 and FIG. 15, and their existence is well known to any person skilled in the art.

Figure 1:
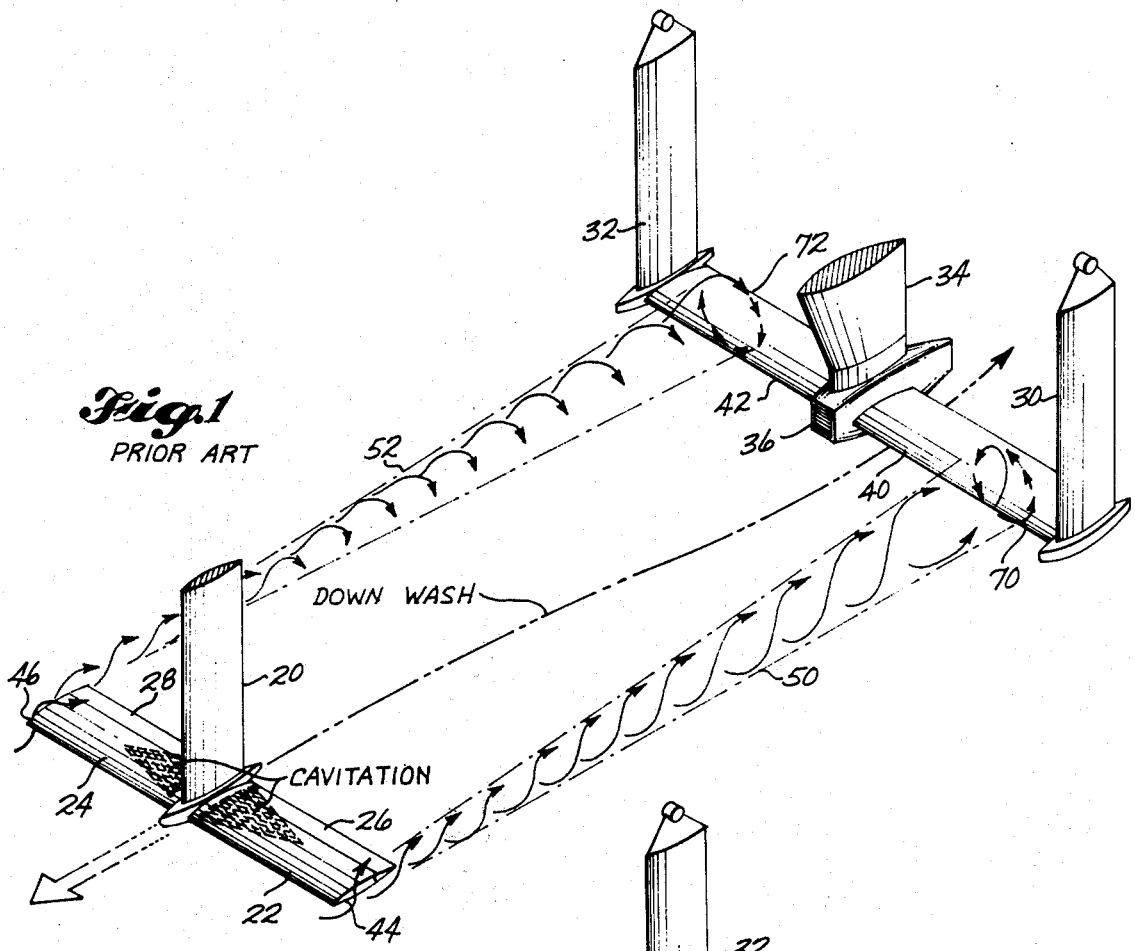
Fig. 1 PRIOR ART
FIG. 1 illustrates a submerged canard strut and foil arrangement of the water jet-powered Boeing commercial hydrofoil, as used presently.

The presence of the tip vortex, as schematically illustrated in FIG. 1, is not desired and is in particular unwanted in the canard foil arrangement.

As indicated in FIG. 1, the forward strut 20 carries a port foil 22 and a starboard foil 24, each having flaps 26 and 28, respectively. The aft foil arrangement utilizes a port strut 30 and a starboard strut 32. An optional center strut 34 with water intake means 36 serves also to support the aft port foil 40 and aft starboard foil 42 in conjunction with the struts 30 and 32.

During forward motion of the hydrofoil craft the forward port and starboard foil tips 44 and 46, respectively, cause a port vortex 50 and a starboard vortex 52 which expand into a whirling water disturbance aftwards and create a counterclockwise motion 70 and a clockwise motion 72 at the aft foil 40 and 42. Besides the loss of lift caused by the vortex action from the forward foils 22 and 24, the clockwise and counterclockwise water flows at the aft foils will cause an unstable lift condition at the outboard portion of the aft foils 40 and 42.

Figure 2:
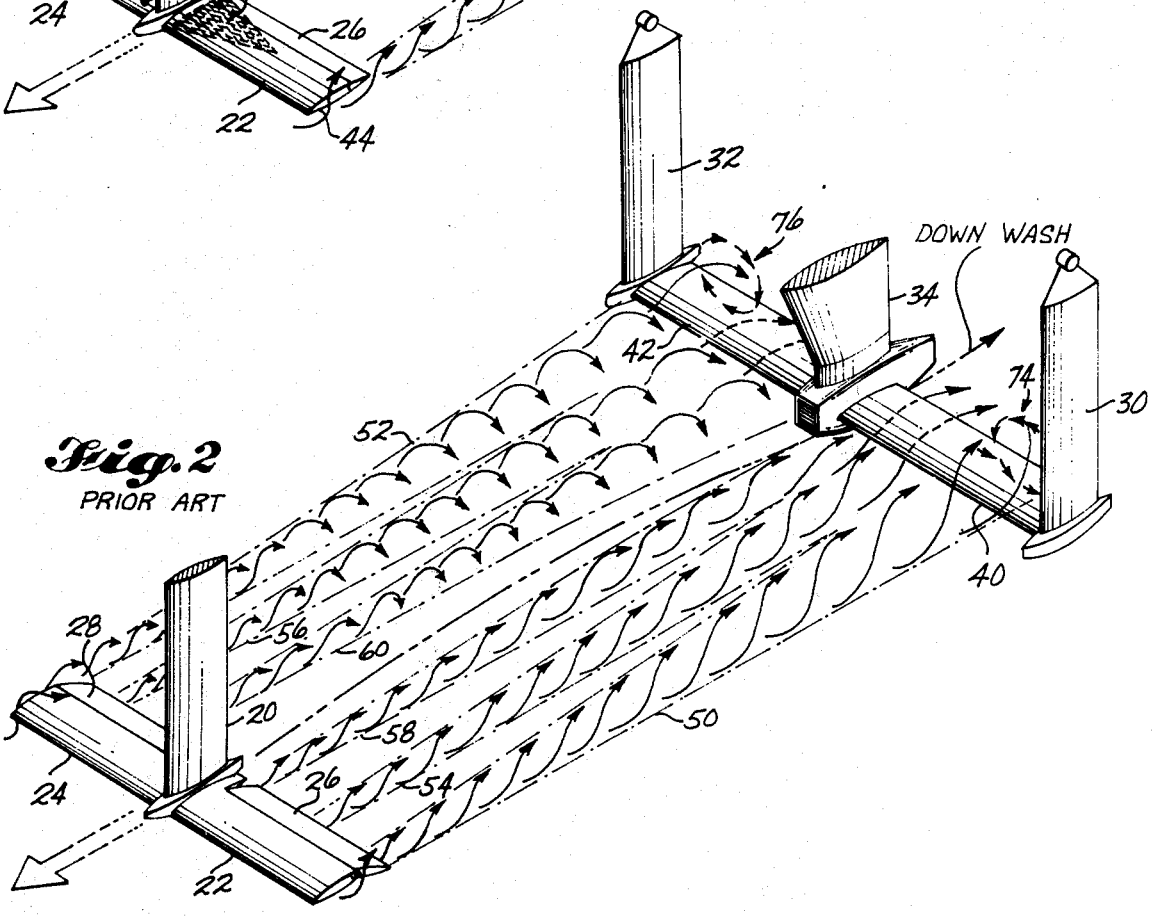
Fig. 2 PRIOR ART
FIG. 2 is the same canard strut and foil arrangement except for a downward forward foil flap deflection.

In addition, it has been discovered that a large, somewhat triangular cavitation area develops at each upper side of the foils 22 and 24. The problem of lift disturbance or loss is even more intensified by the continuous vertical maneuvering of the craft due to its automatic control system inputs and/or control orders at the helm. FIGS. 2, 3 and 4 dramatically illustrate the disturbing flow action (by arrows) that is experienced. As shown, the upward or downward flap positions of the flaps 26 and 28 vary vortex formation at their trailing edges, as illustrated by the vortexes 54, 56, 58 and 60, causing a chaotic whirling 74 and 76 at the aft port and starboard foils 40 and 42. These lift induced vortexes are called downwash and are the least in appearance when no flap action is present such as in FIG. 1. However, tip vortexes are always present, as shown in FIG. 3, when foil is at an angle of attack.

The downward movement of the forward flaps 26 and 28 will intensify the undesired downwash effects as shown in FIG. 4.

FIG. 5 illustrates the total lift profile 80 (schematically shown in dashed-line envelope) as experienced by the forward foils 22 and 24. As indicated, the foil upper surface has in flight a negative pressure (− ) and positive (+ ) below the foil which causes a difference in pressure between these two areas, resulting in a flow 82 which tries to balance the difference.

FIGS. 6 and 7 illustrate the prevention of the conventional flow 82 by the utilization of the foil fences 86 or 88. As noted, each fence will create a different lift profile such as 90 and 92 (schematically shown in dashed-line envelope). It could be said that the foil fences more or less capture the higher pressure area underneath the foil tip and are acting as a stop to a balancing flow 82.

The downwardly protruding fence 86 is structurally unbalanced with respect to the foil and thus a symmetric structurally balanced fence 88 may be preferred. As expected, a larger fence area which is caused by the fence 88 in comparison to the fence 86 would create twice the wetted area and accordingly more drag. But by improving the lift profile at the foil tip as is shown by envelope 92 in FIG. 7, the drag increase is somewhat cancelled out by a gain of lift.

Another advantage of the fences showed up in a smaller cavitation area as shown in FIG. 17 and a reduced downwash at various flap positions. As indicated before, the triangular cavitation area on the non-fence foil as illustrated in FIG. 1 is rather large and due to the effect of a fence almost seems to disappear. (See FIG. 17). The downwash which always exists but is light when travelling in a zero flap position and becomes more intense and rather heavy in subsequent down flap positions (as shown in FIGS. 2 and 4) were substantially reduced in appearance by the presence of fences in accordance with wind tunnel tests.

By trying various fence concepts, three major designs become apparent, each one of which is illustrated successively in FIGS. 8, 9 and 10. The fence in FIG. 9 has the advantage of having an aft portion 96 that is mounted to the flap 26 and thus moves along during vertical maneuvering or control. The forward section 98 is mounted to the non-movable foil tip portion 22. It should be noted that the size of the fence is definitely important and through testing it became apparent that the optimum design is within the area boundaries of a full chord length times one half a chord length in the width of the area. In the fence shown in FIG. 10 the total height of the fence is within a full chord measurement or twice that of the fence height shown in FIG. 8.

The same applies approximately to the fence shown in FIG. 9. However, it is not the intention of the applicant to teach a precise area measurement but to show the best results which were obtained.

The fences have a 45° leading edge sweep and a small aspect ratio to minimize the wetted area.

Of course, it should be understood that the above-mentioned sweep, size area surface and various configurations of the fences as well as the illustration of the fences herein are for the purpose of explanation and not intended to be a limitation. Only the preferred embodiments are shown, with the most preferred fence 86 as illustrated in FIGS. 6, 8 and 17.

In all instances, the fence constructed in accordance with the present invention is a generally streamline fence element extending completely along the chord length at the tip of the foil or, as illustrated in FIG. 9, comprises a dual fence arrangement, with the forward fence extending part way along the chord at the tip of the foil and the aft fence extending completely along the chord of the control surface 26. In all embodiments, the fence has an outboard surface that is convexly curved over substantially its entire length in the chordwise direction of the foil, such as is clearly shown in FIGS. 11 and 12. However, the convex curve is two-dimensional only in the sense that, as seen in FIGS. 13 and 14, for example, the outer convex surfaces are seen as straight lines when they are viewed fin vertical cross section looking in a direction parallel to the longitudinal axis of the hydrofoil craft. Stated in a more precise manner, the line of intersection of the outboard surface of the fence with any plane extending vertically normal to the chordal plane of the foil and extending parallel to the spanwise axis of the foil will always be substantially a straight line. The inboard surface of the fence constructed in accordance with the present invention is substantially planar, as is clearly evident in FIGS. 11, 12 and 17.

Extensive testing of the foil fences demanded the research of toe-in and toe-out mounting, as well as cant-in and cant-out positioning. Furthermore, combinations of the exampled illustrations in FIGS. 11 – 14 were tried as well as fences having a twisted profile.

It appeared that slight gains in lift at certain hydrofoil craft speeds were received; however, it was noted that a toe-out or toe-in mounting in the range of 0°–5° as shown in FIGS. 11 and 12 and also in the cant-in or cant-out positions in the range of 0°–10° may have beneficial effects at certain speeds and angle of attack.

Because the most important effort in the above foil tip fences project was to find improvement in take-off from hullborne to foilborne flight of the hydrofoil craft, the optimum design was primarily directed to take-off and secondary to lift improvement at regular speeds of 40 knots.

In the preceding paragraphs relating to the profile of the fence it was pointed out that certain developments in the aerodynamic field showed wing-fins which were beneficial to cause strong vortex development in order to create thrust. In other applications, fins were designed to keep shock development curtailed at supersonic aircraft speeds. In general, hoever, the fin profiles 120 were symmetric and cambered so that opposed lifting forces were created which cancelled each other. (See FIG. 16). A similar application in the hydrodynamic field appeared to create drag problems which eliminated the lift gain. As shown in FIG. 16, the fins 120 are symmetric and when mounted to the hydrofoil would present a triangular region 122 which produces no or insignificant harm in the aerodynamic field when one travels below the supersonic speed.

In the hydrodynamic application, a separation of the water flow or flow divergence would occur and result in cavitation and another vortex 124. This flow divergence at the relatively low speeds of the hydrofoil craft 0–45 knots is another source for a vortex and since the fence was primarily installed to prevent the tip vortex it is definitely not the purpose to create a new vortex 124.

Accordingly, the present invention teaches a hydrofoil fence design having a cross-section with a flat inboard surface which faces inboard toward the craft.

The preferred embodiment and assembly is shown in FIG. 17.

Referring to FIG. 15, it is illustrated from wind tunnel photographs that a wash-off of the flows 128 occurs at the foil tip 130. This wash-out 128 together with the flow 82 combine into the vortex motion and are the normal cause of the conventional foil tip vortexes 50 and 52.

If one would try to prevent the vortex 50 and 52, a fence would stop most of the flow 82, but if one also prevents the wash-out 128 then the vortex prevention would be improved.

As shown, the flat inboard surface 142 appears to aid the straightening of the flow 128 indicated by the arrows in FIG. 17 as compared to those in FIG. 15.

In summary, the combined effects of the fence, the flat surface and approximate fence area as disclosed herein showed a gain of 4% lift during take-off, as recorded and illustrated in FIG. 18.

While there has been described what is at present considered to be the preferred embodiments of this invention, it will be obvious to those skilled in the art various changes and modifications may be made therein without departing from the invention, and it is, therefore, aimed in the appended claims to cover all such changes and modifications as fall within the true spirit and scope of the invention.

I claim:

1. A vortex control means for a hydrofoil craft lifting foil arranged to generate lift when moved horizontally through water, the foil having an outboard tip with a predetermined chord length, said vortex control means being attached to the foil tip and comprising:

a streamline fence extending completely along said chord length and generally vertically below said foil, the fence having an outboard surface convexly curved over substantially its entire length in the chordwise direction of the foil, and with the line of intersection of the outboard surface with any plane extending vertically normal to the chordal plane of the foil and extending parallel to the spanwise axis off the foil being a substantially straight line, a substantially planar inboard surface, a chordwise dimension corresponding to the chord length of said outboard tip of said foil, and a maximum vertical dimension as measured from the foil chord corresponding generally to one half the chord length of said outboard tip of said foil.

2. The vortex control means recited in claim 1, wherein said fence has a leading edge that extends substantially along a straight line, and is swept back rearwardly from the top of the foil to the bottom of the fence at an angle at approximately 45° from the chordal plane of the foil.

3. The vortex control means recited in claim 2, wherein said fence includes a trailing edge extending downwardly substantially along a straight line, and wherein said fence trailing edge is swept downwardly and forwardly from the foil chordal plane to the bottom of the fence.

4. The vortex control means recited in claim 1, wherein said foil includes a movable control surface at its trailing edge said control surface being mounted for movement about a pivot axis extending spanwise of the foil, and wherein the chordwise dimension of said fence corresponds to the combined chord length of the outboard tip of said foil and said control surface, the outboard edge of said control surface being located contiguous to the inboard side of the fence.

5. A vortex control means as recited in claim 1, wherein the planar inboard surface of said fence is inclined between 0°–10° with respect to the principal longitudinal axis of said foil and 0°–10° with respect to a plane extending parallel to said longitudinal axis and normal to the plane extending chordwise of said foil.

6. A vortex control means as recited in claim 1, wherein said fence extends downwardly but not upwardly from said foil.

7. A vortex control means as recited in claim 1, wherein said fence extends upwardly as well as downwardly from said foil, the fence extending generally vertically from the foil chord plane in both directions to the extent of approximately one-half of the foil chord length at its outboard tip.

8. A vortex control means as recited in claim 7, wherein the leading edge of said fence extends along substantially straight lines that are swept rearwardly from the leading edge of the foil; the upper and lower edges of said fence extend along straight lines that lie substantially parallel to the foil chord; and the trailing edge of said fence extends along substantially straight lines that are swept forwardly from the trailing edge of the foil.

9. A vortex control means for a hydrofoil craft lifting foil arranged to generate lift when moved horizontally through water, the foil having an outboard tip with a predetermined chord length, and a movable control surface pivotally attached to the trailing edge area of the foil, the control surface extending spanwise of the foil to the tip thereof, said vortex control means comprising:

a first streamline fence attached to the tip of the foil and extending vertically with respect to said foil approximately one half of the foil chord length at its outboard tip on either side of the chord line of the foil, and fore and aft approximately 50% of the foil chord length at its outboard tip;

a second streamline fence attached to the tip of the said control surface, said second fence extending vertically with respect to said control surface approximately one half of the control surface chord length on either side of the chord line of the control surface, and fore and aft for approximately the entire chord length of the control surface, said second fence being mounted for movement with the control surface.

10. The vortex control means recited in claim 9, wherein at least the first fence has a substantially planar inboard surface and a convex curved outboard surface.

11. The vortex control means recited in claim 10, wherein both fences have substantially planar inboard surface and convex curved outer surfaces.

12. The vortex control means recited in claim 10, wherein the leading edges of the first and second fences are swept back approximately 45° from the chordline of the foil and control surface, respectively.

13. The vortex control means recited in claim 10, wherein the said outboard surface of said first fence is convexly curved over substantially its entire length in the chordwise direction of the foil, with the line of intersection of the outboard surface with any plane extending vertically normal to the chordal plane of the foil and extending parallel to the spanwise axis of the foil being a substantially straight line.

14. The vortex control means recited in claim 9, wherein both fences have substantially planar inboard surfaces and convex curved outboard surfaces, the outboard surfaces of each fence being curved over substantially its entire length in the chordwise direction of the foil, with the line of intersection of the outboard surface of each fence with any plane extending vertically normal to the chordal plane of the foil and extending parallel to the spanwise axis of the foil being substantially a straight line.

* * * * *